US005695096A

United States Patent [19]

Yquel

[11] Patent Number: 5,695,096

[45] Date of Patent: Dec. 9, 1997

[54] DISPENSING VALVE AND DISPENSING CONTAINER EQUIPPED WITH SUCH A VALVE

[75] Inventor: Jean-Pierre Yquel, Colombes, France

[73] Assignee: L'Oreal, Paris, France

[21] Appl. No.: 538,284

[22] Filed: Oct. 2, 1995

[30] Foreign Application Priority Data

Sep. 30, 1994 [FR] France ..... 94-11741

[51] Int. Cl.[6] ..... B65D 83/14

[52] U.S. Cl. ..... 222/402.18; 222/148

[58] Field of Search ..... 222/148, 402.18, 222/144.5, 129

[56] References Cited

U.S. PATENT DOCUMENTS

| | | | |
|---|---|---|---|
| 2,867,356 | 1/1959 | Thomas | 222/402.18 X |
| 3,033,473 | 5/1962 | Kitabayashi | 222/402.18 X |
| 3,061,203 | 10/1962 | Kitabayashi | 222/402.18 X |
| 3,217,936 | 11/1965 | Abplanalp | 222/402.18 X |
| 3,283,962 | 11/1966 | Whitmore | 222/402.18 |
| 3,341,082 | 9/1967 | Meshberg | 222/402.18 X |
| 3,406,877 | 10/1968 | Frangos | 222/402.18 X |
| 3,497,112 | 2/1970 | Samuelson | 222/402.18 X |
| 3,575,320 | 4/1971 | Prussin et al. | 222/402.18 X |
| 3,612,361 | 10/1971 | Ewald et al. | 222/402.18 |
| 4,211,347 | 7/1980 | Mildern | 222/402.18 |
| 4,431,119 | 2/1984 | Stoody | 222/402.18 X |

FOREIGN PATENT DOCUMENTS

| | | |
|---|---|---|
| 2224990 | 10/1974 | France . |
| 2 209 805 | 5/1989 | United Kingdom . |
| WO 93/01996 | 2/1993 | WIPO . |

*Primary Examiner*—Kevin P. Shaver

*Attorney, Agent, or Firm*—Young & Thompson

[57] ABSTRACT

Valve (3) for dispensing a product using a propellent gas, comprising a chamber (5) communicating with the product, in which chamber there is mounted a nozzle stem element (7) fitted with an ejection passageway (11*a*, 11*b*) placing the outside in communication with the chamber, the nozzle stem element being urged by a spring (13) towards a first position in which the passageway is closed; an additional gas intake orifice (14); a moving annular seal (15) arranged on the nozzle stem element and, in the position of rest, closing off the orifice and dividing the chamber into a first compartment (A) and a second compartment (B), the chamber and the nozzle stem element in a second position placing the orifice and the outside in communication for letting the gas out, the first and second compartments being separated, structure (C) for temporary communication being provided in the chamber, this structure being inoperative in the first and second positions and operative in a third position of the nozzle stem element to place the first and second compartments in communication.

9 Claims, 2 Drawing Sheets

DISPENSING VALVE AND DISPENSING CONTAINER EQUIPPED WITH SUCH A VALVE

The present invention relates to a dispensing valve for dispensing a product with the aid of a propellent gas, or a mixture of propellent gases under pressure, as well as to a dispenser equipped with this valve. This valve is designed to equip a dispenser of liquid, pasty or pulverulent product, allowing the user to dispense the product in the form of fine droplets, particles, foam or mousse. More particularly, this valve is suitable for dispensing compositions which, by drying up, run the risk of blocking a conventional dispensing system. Among the compositions which may be dispensed with the aid of this valve, there may be mentioned, by way of example, paints, liquid glues, hair lacquer and mousse, shaving foams, etc.

Document EP-A-0,583,350 makes known a dispenser for liquid product dispensed by means of a propellent gas, comprising a reservoir containing the liquid to be dispensed and the propellent gas, equipped with a dispensing valve, the valve being fastened onto the container by a dished part. This valve includes a body of cylindrical shape defining a chamber comprising a dip tube for sucking up the liquid product. Mounted in this body, so that it can slide, is a nozzle stem element having a first cylindrical portion and a second cylindrical portion which define an annular stop, this nozzle stem element being intended to take a dispensing sprayhead. An axial ejection passageway is made in the first portion of the nozzle stem element in order to place the outside of the nozzle stem element in communication with the inside of the valve body via an orifice passing through the wall of the nozzle stem element. The nozzle stem element can move in the opening of a first stationary seal placed between the body and the dished part, the thickness of which is greater than the cross-section of the orifice. The nozzle stem element is urged by elastic return means towards a first position of rest in which the stop interacts with the seal and in which the orifice emerges in the thickness of the seal. An additional gas intake orifice is provided in the valve body in order to place the chamber in communication with the volume of the container in which the propellent gas under pressure is situated, so that a mixture of liquid and propellent gas is formed in the chamber and is conveyed towards a dispensing spray nozzle. A second, moving, annular seal is arranged around the second portion of the nozzle stem element and, in the position of rest, closes off the additional gas intake orifice.

This dispenser exhibits satisfactory operation when the product to be dispensed is relatively liquid. However, when the product to be dispensed is a composition based on substances dissolved in a solvent, such as a hair lacquer or a paint, an amount of product remains, after each dispensing operation, in the dispensing system where the solvent evaporates. After several dispensing operations the dry residue resulting from this evaporation ends up blocking the dispensing system, especially the nozzle stem element or the dispensing spray nozzle.

The present invention aims to remedy this drawback by proposing a valve capable automatically of cleaning out the dispensing system before and after each operation of dispensing an amount of product. This cleaning-out is carried out by sending a jet of propellent gas into the dispensing system, driving out any product residue before and after each dispensing operation.

Thus the invention relates to a dispensing valve for dispensing a product with the aid of a propellent gas under pressure, comprising: a body defining a chamber comprising a first orifice for taking in the product, in which body is slidingly mounted a nozzle stem element having a first cylindrical portion and a second cylindrical portion which define an annular stop; an ejection passageway provided in the first portion in order to place the outside of the nozzle stem element in communication with the inside of the body of the valve, the nozzle stem element being movable inside the opening of a stationary seal fitted at the top of the valve body, and the thickness of which is greater than the cross-section of the passageway, the nozzle stem element being urged by elastic return means towards a first, rest position in which the stop interacts with the stationary seal and in which the passageway opens out in the thickness of the seal; a second orifice acting as an additional gas intake provided in the body of the valve and intended to be fed with propellent gas; a movable annular seal arranged around the second portion and, in the rest position, closing off the second orifice and dividing the chamber into a first compartment and a second compartment, the inside of the valve body and the nozzle stem element being arranged so that when the nozzle stem element is partially depressed into a second position, a communication is set up between the second orifice and the outside for the passage of propellent gas towards the outside via the first compartment and the passageway of the nozzle stem element, and so that the first compartment and second compartment are separated, a means of temporary communication being provided inside the body of the valve, this means being inoperative in the first and second positions of the nozzle stem element and operative when the nozzle stem element is depressed to the maximum extent into a third position, in order to place the first compartment and second compartment in communication and thus dispense a mixture of product and of gas.

The product to be dispensed may be a liquid, pasty or pulverulent product under the action of a propellent gas chosen, advantageously, from among liquefiable hydrocarbons and chlorofluorocarbons, nitrogen, carbon dioxide, compressed air, or a mixture of these gases.

Advantageously, the first intake orifice is connected to a dip tube dipping down into the product to be dispensed. It is equally possible to attach this intake orifice directly to a flexible pocket in which the product is contained.

According to the invention, the means for temporary communication may consist of at least one longitudinal and/or circular groove provided in an internal wall of the body of the valve emerging on either side of the moving annular seal in the first compartment and second compartment when the nozzle stem element is in the third position, that is to say when the nozzle stem element is in the position in which it is depressed by the maximum amount.

The annular seal may be an attached O-ring, for example made of elastomeric material. This annular seal may equally well be in the form of a cylindrical bead resulting from integral moulding with the nozzle stem element.

Advantageously the elastic return means consist of a helical spring.

Through the provisions which have just been described, a valve is obtained which, before and after each operation of dispensing an amount of product, cleans out the dispensing system of the valve, this system comprising, in succession, the additional gas intake orifice, the first compartment of the valve, the ejection passageway of the nozzle stem element, and the ducts of a push-button with which this valve is advantageously equipped for actuating it and dispensing the product.

Another advantage offered by this valve lies in the fact that after an amount of product has been dispensed, there is no communication between the additional propellent gas intake orifice and the intake orifice. This propellent gas cannot therefore penetrate the second compartment or the dip tube or the pocket containing the product, which is not the case of a conventional additional gas intake valve. For conventional valves, before each operation of dispensing product, a significant amount of gas is ejected, this being prejudicial to the complete emptying of the reservoir, particularly if the dispensing of the product is frequently interrupted. The problem of wastage of propellent gas is posed, in particular, if the propellent gas chosen is a non-liquefiable gas such as compressed air. In point of fact, it is known that dispensing of a product using a non-liquefiable gas makes it necessary either to use a container of considerable volume to store a great enough volume of gas for the complete emptying of the reservoir, or the use of a compressed gas refill system, which leads to costly equipment. Thus, the valve of the invention, owing to the reduced gas consumption, makes it possible to equip a container of reduced volume, without it being necessary to refill with compressed gas before the reservoir has been completely emptied.

The invention also relates to a dispenser for dispensing a product with the aid of a propellent gas under pressure, comprising: a reservoir of product, closed by a dished fastening part bearing a valve equipped with a push-button for actuating it, provided with a dispensing spray nozzle, this valve comprising a body which defines a chamber communicating with the product via a first intake orifice and in which body there is slidingly mounted a nozzle stem element having a first cylindrical portion and a second cylindrical portion which define an annular stop; an ejection passageway provided in the first portion in order to place the outside of the nozzle stem element in communication with the inside of the body of the valve, the nozzle stem element being movable inside the opening of a stationary seal fitted at the top of the valve body, and the thickness of which is greater than the cross-section of the passage, the nozzle stem element being urged by elastic return means towards a first, rest position in which the stop interacts with the stationary seal and in which the passageway opens out in the thickness of the seal; a second orifice acting as an additional gas intake provided in the body of the valve in order to place the chamber in communication with the volume of the reservoir in which the propellent gas is situated; a movable annular seal arranged around the second portion and, in the rest position, closing off the second orifice and dividing the chamber into a first compartment and a second compartment, the inside of the valve body and the nozzle stem element being arranged so that when the nozzle stem element is partially depressed into a second position, a communication is set up between the second orifice and the outside for the passage of the propellent gas towards the outside via the first compartment and the passageway of the nozzle stem element, and so that the first compartment and second compartment are separated, a means of temporary communication being provided inside the body of the valve, this means being inoperative in the first and second positions of the nozzle stem element and operative when the nozzle stem element is depressed to the maximum extent into a third position, in order to place the first compartment and second compartment in communication and thus dispense a mixture of product and of gas.

Advantageously, the dispensing container is equipped with a valve including means for temporary communication, consisting of at least one longitudinal and/or circular groove provided in an internal wall of the body of the valve emerging on either side of the moving annular seal in the first compartment and second compartment when the nozzle stem element is in the third position.

For preference, the elastic return means consist of a helical spring, advantageously made of metal.

Advantageously, the stationary seal is placed at the top of the valve body between the valve chamber and its dished fastening part.

The invention consists, apart from the provisions explained hereinabove, in a certain number of other provisions which will be dealt with more fully later with regard to exemplary embodiments described with reference to the appended drawings, but which are in no way limiting.

Figure 1:
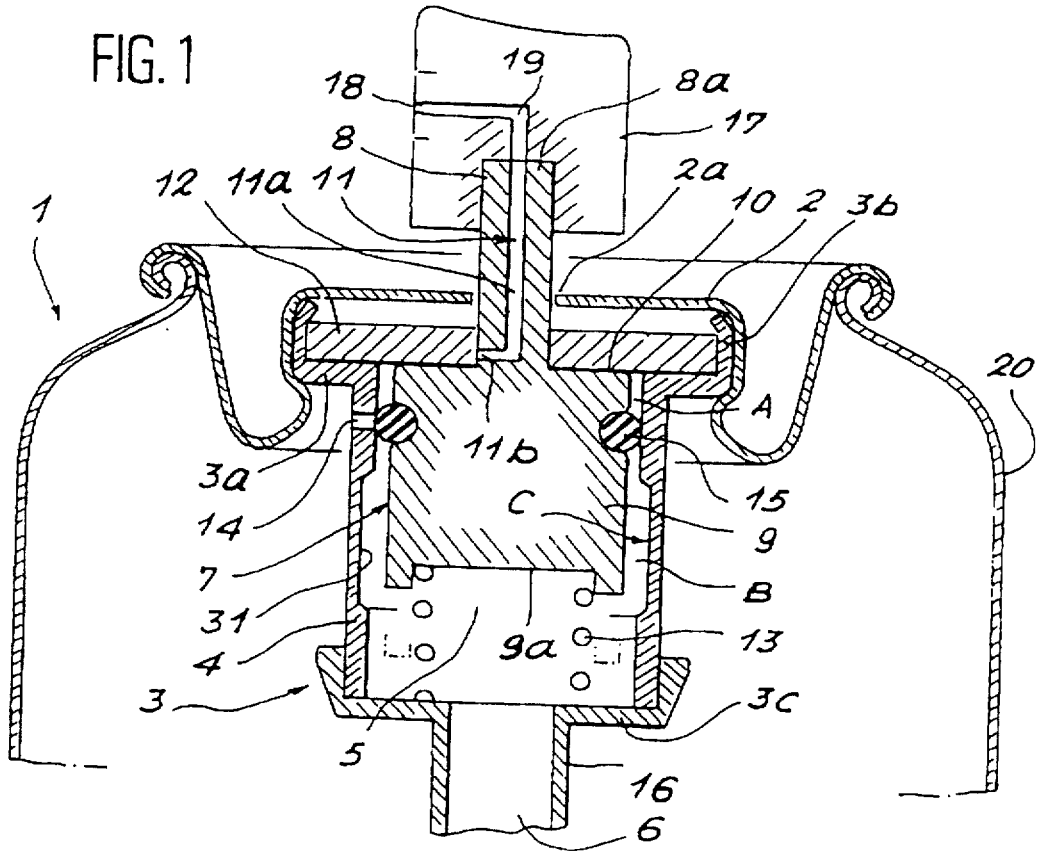
FIG. 1 is a part section through a dispensing container equipped with a dispensing valve in accordance with the invention, in the position of rest.
Figure 2:
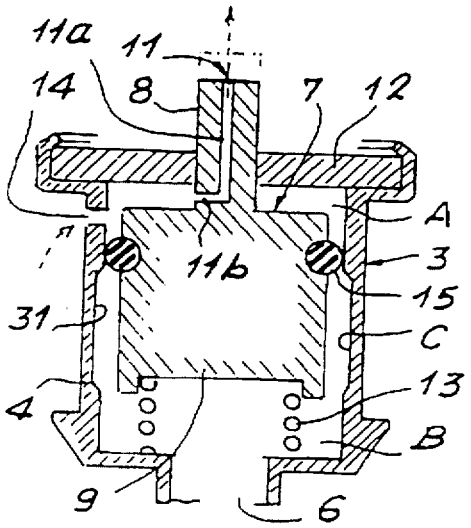
FIG. 2 shows a section through the valve of FIG. 1, in the cleaning-out position.
Figure 3:
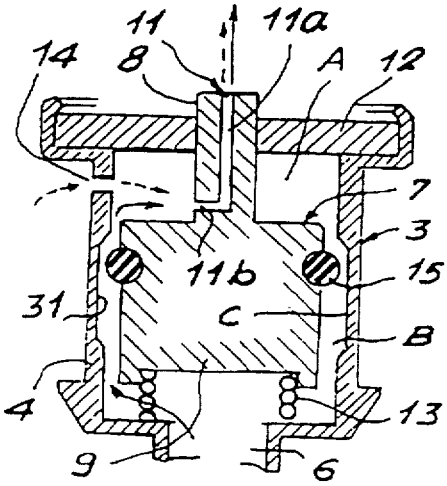
FIG. 3 is a section through the valve of FIG. 1, in the dispensing position.

With reference to the appended FIGS. 1 to 3, the reference 1 has been used to denote a container capped by a dished part 2.

According to FIG. 1, the dispensing container 1 in accordance with the invention consists of a cylindrical casing 20 having a bottom, not represented, at its lower part and closed at its upper part by a dished part 2. The container 1 is filled with a product to be dispensed of liquid, pasty or pulverulent, especially liquid, consistency and of a propellent gas or a mixture of gases, such as the liquefiable gases and/or compressed gases, especially compressed air. This product may be a hair lacquer, paint, a foaming composition, etc.

The container 1 is surmounted by a dispensing valve 3 comprising a body 4 of cylindrical overall shape, and a nozzle stem element 7 acting as a member for operating the valve. The valve body at its upper part has a circular plate 3*a* extended by a cylindrical skirt 3*b* inside which there is arranged a first, stationary, elastomeric seal 12 in the form of a washer. The valve body 4 has an end 3*c* thus defining a chamber 5; this end includes a product intake orifice 6 extended by a dip tube 16 dipping down into the product. This dip tube is not necessary if the liquid is contained in a flexible pocket (not represented) connected to the valve body 4. In this case, the end 3*a* advantageously includes means for attaching the pocket. The end 3*a* may form part of the valve body 4 or constitute a separate part, snap-fastened or glued to the valve body 4.

Fixed to the skirt 3*b* of the valve body, by crimping or expansion rolling, is a dished fastening part 2, for example made of metal, immobilizing the stationary seal 12. The transverse wall of the dished part 2 includes a central circular orifice 2*a*. The nozzle stem element 7 comprises two coaxial cylindrical portions 8 and 9 defining an annular stop 10. The portion 8 has a diameter slightly less than that of the orifice 2*a* of the dished part and passes through the stationary seal 12 and the orifice 2*a* so that its emerging end 8*a* can take a push-button 17 provided with an elbowed outlet passageway 19 which leads towards a dispensing spray nozzle 18. Furthermore, the portion 8 of the nozzle stem element 7 is provided with an ejection passageway 11 comprising a blind axial part 11*a* which connects to a radial part 11*b* passing through the wall of the portion 8. This radial part 11*b* is situated, when the valve is in the position of rest, in the thickness of the stationary seal 12 and is closed off thereby.

The portion 9 of the nozzle stem element 7 extends into the chamber 5 of the valve body and its outside diameter is less than that of the internal wall of the valve body 4. This portion 9 is fitted with a second, moving, annular seal 15 so that the nozzle stem element 7 is capable of sliding, in a sealed fashion, in the valve body 4, dividing the chamber 5 into two compartments A and B. The portion 9 includes a bottom 9*a* resting elastically against a helical spring 13 arranged between it and the bottom 3*c* of the valve body 4.

The second, moving, annular seal 15 is an O-ring preferably made of elastomeric material. However, it is possible to make this seal by overinjecting an appropriate substance, for example made of elastomeric material, onto the periphery of the portion 9 of the nozzle stem element 7.

A small orifice 14 is formed in the wall of the valve body 4 and is capable of causing the upper volume of the reservoir to communicate with the chamber 5 of the valve. This orifice 14 is sited so that when the nozzle stem element 7 is in the position of rest, the second seal 15 borne thereby can close off the orifice 14.

The valve body 4 includes at least one longitudinal and/or circular groove 31, the role of which will be explained later during the description of the operation of the valve, the length of which groove is greater than the thickness of the second seal 15 and which groove is situated at a lower level than the additional gas intake orifice 14, if this orifice is in the extension of the longitudinal groove 31, or at most level with its orifice 14 if this longitudinal groove 31 is offset with respect to the orifice 14 by a certain angle.

The operation of the dispensing container 1 in accordance with the invention is as follows: in the position of rest, the valve 3 is closed, that is to say that the additional gas intake orifice 14 is plugged by the second, moving, seal 15 and the passageway 11*b* is closed off by the first seal 12. The second, moving, seal 15 also separates the compartments A and B in leaktight manner so that the liquid in the compartment B cannot pass into the compartment A (FIG. 1).

In order to dispense an amount of product, the user presses on the push-button 17, causing a downwards movement of the nozzle stem element 7. The latter occupies an intermediate position as shown in FIG. 2 in which the second, moving, seal 15 frees the additional gas intake orifice 14, while separating the compartments A and B. In this position, the passageway 11*b* of the nozzle stem element is sited below the first seal 12 and a quantity of gas passes through the orifice 14, escaping via the dispensing spray nozzle 18 via the compartment A, the passageway 11*b*, the blind passageway 11 and the elbowed passageway 19 in the push-button 17.

At the end of travel which corresponds to the dispensing phase, the nozzle stem element 7 occupies the position given in FIG. 3. The second, moving, seal 15 is then in line with the longitudinal groove 31 emerging on either side of the moving seal 15 in the compartments A and B respectively. The liquid contained in the reservoir 20, under the thrust of the propellent gas, can then pass from the compartment B into the compartment A where a mixture of the liquid with the propellent gas is produced. This mixture is conveyed towards the dispensing spray nozzle 18.

When the user stops the dispensing operation, before reaching the position of rest, the nozzle stem element 7 passes through the intermediate position described hereinabove with reference to FIG. 2. This results in a dispensing of gas alone, which expels any product to be found in the dispensing system, between the additional gas intake orifice 14 and the dispensing spray nozzle 18. The risks of the product drying in the dispensing system and of the latter becoming blocked by the resulting dry residues are thus considerably reduced.

Figure 4:
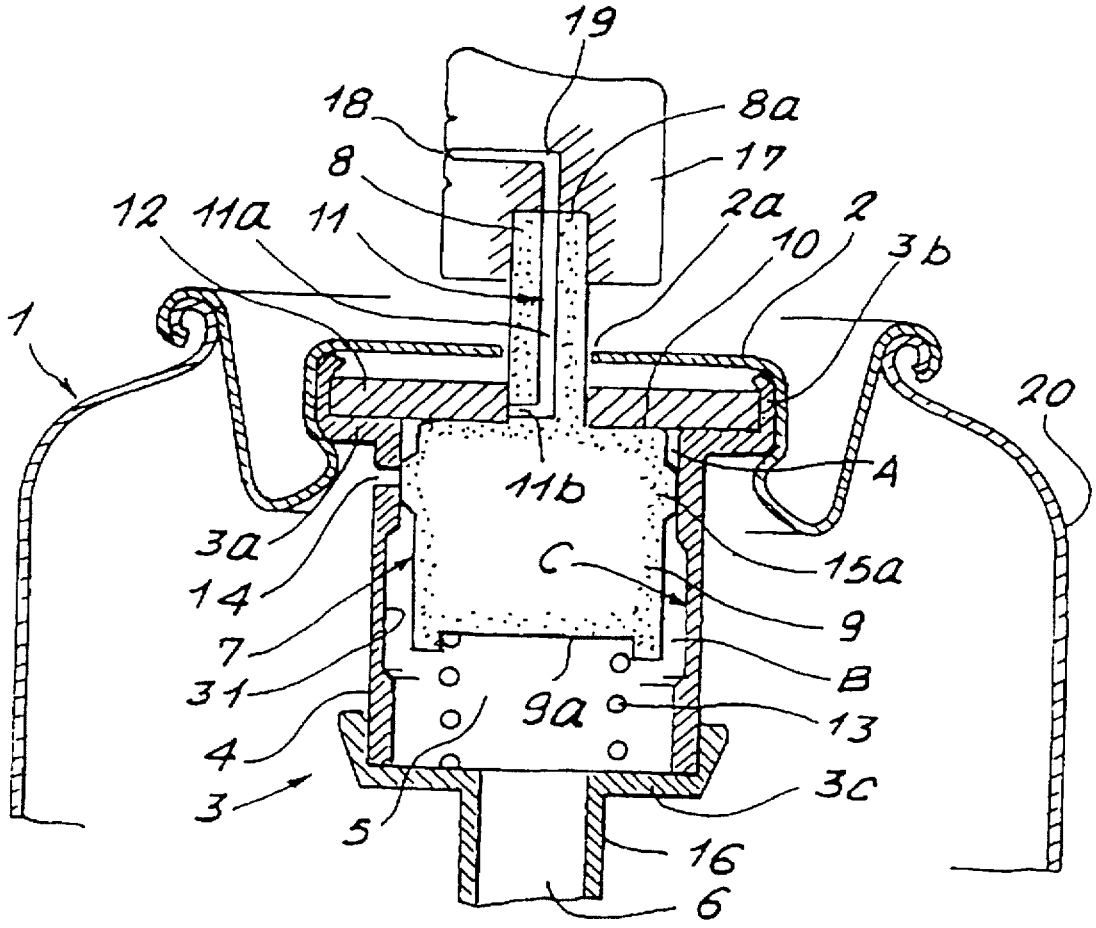
FIG. 4 shows an alternative to the dispenser of FIG. 1, the seal and the nozzle stem element being formed as a single piece.

FIG. 4 shows an alternative to the valve of FIG. 1, according to which the O-ring 15 of FIG. 1 has been replaced by a seal in the form of a cylindrical bead 15*a* formed integrally with the nozzle stem element 7 during moulding. This bead 15*a* can be obtained by overinjection of a suitable substance, for example an elastomeric substance, on the periphery of the portion 9 of the nozzle stem element 7. The operation of this valve is identical to that described with reference to the valve in accordance with FIGS. 1 to 3.

I claim:

1. In a valve for dispensing a product with the aid of a propellent gas under pressure, comprising: a body (4) defining a chamber (5) comprising a first orifice (6) for taking in the said product, in which body (4) there is slidingly mounted a nozzle stem element (7) having a first cylindrical portion (8) and a second cylindrical portion (9) which define an annular stop (10); an ejection passageway (11*a*, 11*b*) provided in the first portion (8) in order to place an outside of the nozzle stem element (7) in fluid communication with an inside of the body (4) of the valve (3), the nozzle stem element (7) being movable inside an opening of a stationary seal (12) fitted at the tip of the valve body (4), and a thickness of which is greater than the cross-section of the passageway (11*a*, 11*b*), the nozzle stem element being urged by elastic return means (13) towards a first, rest position in which the stop (10) interacts with the stationary seal (12) and in which the passageway (11*a*, 11*b*) opens out in the thickness of the seal (12); a second orifice acting as an additional gas intake (14) provided in the body (4) of the valve (3) and intended to be fed with propellent gas; a movable annular seal (15) arranged around the second portion (9) and, in the rest position, closing off the second orifice (14) and dividing the chamber (5) into a first compartment (A) and a second compartment (B); the improvement comprising means whereby when the nozzle stem element (7) is partially depressed into a second position, a fluid communication is set up between the second orifice (14) and the outside for the passage of propellent gas towards the outside via the first compartment (A) and the passageway (11*a*, 11*b*) of the nozzle stem element (7), and whereby the first compartment (A) and second compartment (B) are separated; a means (C) of temporary communication being provided inside the body (4) of the valve (3), this means being inoperative in the first and second positions of the nozzle stem element (7) and operative when the nozzle stem element (7) is depressed to a maximum extent into a third position, in order to place the first compartment (A) and second compartment (B) in communication and thus dispense a mixture of product and of gas.

2. Valve according to claim 1, wherein the means (C) for temporary communication consists of at least one groove (31) provided in an internal wall of the body (4) of the valve (3), emerging on either side of the moving annular seal (15) in the first compartment (A) and second compartment (B) when the nozzle stem element (7) is in the third position.

3. Valve according to claim 1, wherein the annular seal (15) is an O-ring.

4. Valve according to claims 1, wherein the annular seal (15) is a cylindrical bead formed integrally by moulding of the nozzle stem element (7).

5. Valve according to claim 1, wherein the elastic return means (13) consists of a helical spring.

6. In a dispenser (1) for dispensing a product with the aid of a propellent gas under pressure, comprising: a reservoir (20) of product, closed by a dished fastening part (2) bearing a valve (3) equipped with a push-button (17) for actuating the valve (3), provided with a dispensing spray nozzle (18), this valve (3) comprising a body (4) which defines a chamber (5) communication with the product via a first intake orifice (6) and in which body (4) there is slidingly mounted a nozzle stem element (7) having a first cylindrical portion (8) and a second cylindrical portion (9) which define an annular stop (10); an ejection passageway (11*a*, 11*b*) provided in the first portion (8) in order to place an outside of the nozzle stem element (7) in communication with an inside of the body (4) of the valve (3), the nozzle stem element (7) movable inside an opening of a stationary seal (12) fitted at the top of the valve body (4), and a thickness of which is greater than the cross-section of the passage (11*a*, 11*b*), the nozzle stem element being urged by elastic return means (13) towards a first, rest position in which the stop (10) interacts with the stationary seal (12) and in which the passageway (11*a*, 11*b*) opens out in the thickness of the seal (12); a second orifice acting as an additional gas intake (14) provided in the body (4) of the valve (3) in order to place the chamber (5) in fluid communication with the reservoir (20) in which the propellent gas is situated; a movable annular seal (15) arranged around the second portion (9) and, in the rest position, closing off the second orifice (14) and dividing the chamber (5) into a first compartment (A) and a second compartment (B); the improvement comprising means whereby when the nozzle stem element (7) is partially depressed into a second position, a fluid communication is set up between the second orifice and an outside for passage of the propellent gas towards the outside via the first compartment (A) and the passageway (11*a*, 11*b*) of the nozzle stem element (7), and whereby the first compartment (A) and second compartment (B) are separated; a means (C) of temporary communication being provided inside the body (4) of the valve (3), this means being inoperative in the first and second positions of the nozzle stem element (7) and operative when the nozzle stem element (7) is depressed to a maximum extent into a third position, in order to place the first compartment (A) and second compartment (B) in communication and thus dispense a mixture of product and of gas.

7. Dispenser according to claim 6, wherein the means (C) for temporary communication consists of at least one groove (31) provided in an internal wall of the body (4) of the valve (3) emerging on either side of the moving annular seal (15) in the first compartment (A) and second compartment (B) when the nozzle stem element (7) is in the third position.

8. Dispenser according to claim 6, wherein the elastic return means (13) consists of a helical spring.

9. Dispenser according to claim 6, characterized in that the stationary seal (12) is placed at a top of the valve body (4) between the chamber (5) and the dished fastening part (2).

* * * * *